US011448111B2

(12) United States Patent
Maertens

(10) Patent No.: US 11,448,111 B2
(45) Date of Patent: Sep. 20, 2022

(54) METHOD FOR ADAPTING AN AMOUNT OF REDUCTANT FOR CONTROLLING THE NITROGEN OXIDE POLLUTION OF GASES IN A MOTOR EXHAUST LINE

(71) Applicants: CONTINENTAL AUTOMOTIVE FRANCE, Toulouse (FR); CONTINENTAL AUTOMOTIVE GMBH, Hanovre (DE)

(72) Inventor: Steven Maertens, Toulouse (FR)

(73) Assignees: CONTINENTAL AUTOMOTIVE FRANCE, Toulouse (FR); CONTINENTAL AUTOMOTIVE GMBH, Hanover (DE)

( * ) Notice: Subject to any disclaimer, the term of this patent is extended or adjusted under 35 U.S.C. 154(b) by 246 days.

(21) Appl. No.: 16/633,354

(22) PCT Filed: Jul. 16, 2018

(86) PCT No.: PCT/FR2018/051802
§ 371 (c)(1),
(2) Date: Jan. 23, 2020

(87) PCT Pub. No.: WO2019/020901
PCT Pub. Date: Jan. 31, 2019

(65) Prior Publication Data

US 2021/0372309 A1 Dec. 2, 2021

(30) Foreign Application Priority Data

Jul. 25, 2017 (FR) ..... 1757026

(51) Int. Cl.
*F01N 3/00* (2006.01)
*F01N 3/20* (2006.01)
(Continued)

(52) U.S. Cl.
CPC ..... *F01N 3/208* (2013.01); *F01N 3/0814* (2013.01); *F01N 3/101* (2013.01); *F01N 3/2073* (2013.01);
(Continued)

(58) Field of Classification Search
CPC ..... F01N 3/208; F01N 3/0814; F01N 3/101; F01N 3/2073; F01N 11/00; F01N 13/008;
(Continued)

(56) References Cited

U.S. PATENT DOCUMENTS 6,131,439 A 10/2000 Hamburg et al.
6,209,313 B1 4/2001 Wissler et al.
(Continued)

FOREIGN PATENT DOCUMENTS

CN 101326348 A 12/2008
CN 101501317 A 8/2009
(Continued)

OTHER PUBLICATIONS

Examination Report issued in IN Patent Application No. 202017002945 dated Aug. 31, 2021, with English translation provided.
(Continued)

*Primary Examiner* — Matthew T Largi
(74) *Attorney, Agent, or Firm* — Nixon & Vanderhye

(57) ABSTRACT

In a process for adapting an amount of reducing agent for a removal of nitrogen oxides from the gases in an exhaust line, a first alignment of the amounts of nitrogen oxides measured by upstream and downstream sensors is performed without injection of agent and with a catalyst of the system emptied of ammonia. A second alignment of the estimated reduction of nitrogen oxides with the measured reduction is performed by a difference between amounts of nitrogen oxides upstream and downstream during a substoichiometric injection of reducing agent without creating a store of ammonia
(Continued)

in a catalyst of the system with a first correction of the amount of agent. A third alignment of an estimated efficiency of retaining nitrogen oxides with a efficiency measured by the sensors is performed, this third alignment taking place via a second correction of the amount of reducing agent injected as an adaptive correction.

19 Claims, 3 Drawing Sheets

(51) Int. Cl.

| | |
|---|---|
| ***F01N 13/00*** | (2010.01) |
| ***F01N 3/08*** | (2006.01) |
| ***F01N 3/10*** | (2006.01) |
| ***F01N 11/00*** | (2006.01) |

(52) U.S. Cl.
CPC ..... *F01N 11/00* (2013.01); *F01N 13/008* (2013.01); *F01N 13/009* (2014.06); *F01N 2550/02* (2013.01); *F01N 2560/021* (2013.01); *F01N 2560/026* (2013.01); *F01N 2560/14* (2013.01); *F01N 2610/02* (2013.01); *F01N 2900/0408* (2013.01); *F01N 2900/1402* (2013.01); *F01N 2900/1614* (2013.01); *F01N 2900/1616* (2013.01); *F01N 2900/1621* (2013.01)

(58) Field of Classification Search
CPC ..... F01N 13/009; F01N 2550/02; F01N 2560/021; F01N 2560/026; F01N 2560/14; F01N 2610/02; F01N 2900/0408; F01N 2900/1402; F01N 2900/1614; F01N 2900/1616; F01N 2900/1621
See application file for complete search history.

(56) References Cited

U.S. PATENT DOCUMENTS

| | | | | |
|---|---|---|---|---|
| 6,775,158 | B2 | 8/2004 | Fu | |
| 7,603,226 | B2 | 10/2009 | Henein | |
| 7,980,059 | B2 | 7/2011 | Shibata et al. | |
| 8,191,357 | B2 | 6/2012 | Doring et al. | |
| 8,893,475 | B2 | 11/2014 | Geveci et al. | |
| 8,923,365 | B2 | 12/2014 | Zoels et al. | |
| 9,492,788 | B2 | 11/2016 | Gaudin | |
| 10,145,722 | B2 | 12/2018 | Bauer et al. | |
| 2003/0024300 | A1 | 2/2003 | Kojima | |
| 2003/0041592 | A1 | 3/2003 | Nishioka et al. | |
| 2009/0155130 | A1 | 6/2009 | Choi | |
| 2010/0024389 | A1 | 2/2010 | Gady et al. | |
| 2011/0099985 | A1* | 5/2011 | Yasui | F01N 3/208 60/287 |
| 2013/0000276 | A1 | 1/2013 | Grichnik et al. | |
| 2014/0199219 | A1* | 7/2014 | Christner | B01D 53/9431 423/212 |
| 2014/0301925 | A1* | 10/2014 | Korpics | F01N 11/00 423/212 |
| 2015/0033705 | A1 | 2/2015 | Anilovich et al. | |
| 2015/0177746 | A1* | 6/2015 | Cho | F01N 3/208 700/266 |
| 2015/0226102 | A1 | 8/2015 | Hsieh et al. | |
| 2016/0369677 | A1* | 12/2016 | Ponnathpur | B01D 53/9495 |

FOREIGN PATENT DOCUMENTS

| | | | |
|---|---|---|---|
| CN | 101637703 | A | 2/2010 |
| CN | 101915148 | A | 12/2010 |
| CN | 103527289 | A | 1/2014 |
| CN | 104220710 | A | 12/2014 |
| CN | 104533583 | A | 4/2015 |
| CN | 105452821 | A | 3/2016 |
| DE | 102008047807 | A1 | 6/2009 |
| DE | 102008003685 | A1 | 7/2009 |
| DE | 102010005428 | A1 | 7/2011 |
| DE | 102012212565 | A1 | 1/2014 |
| DE | 102015007751 | A1 | 1/2016 |
| EP | 0 998 627 | A1 | 5/2000 |
| EP | 2942502 | A1 | 11/2015 |
| FR | 2995008 | A1 | 3/2014 |
| FR | 3016924 | A1 | 7/2015 |
| SE | 1550554 | A1 | 12/2016 |
| WO | 99/05402 | A1 | 2/1999 |
| WO | 2010/068147 | A1 | 6/2010 |
| WO | 2013/003710 | A2 | 1/2013 |
| WO | 2014/103798 | A1 | 7/2014 |
| WO | 2014/108619 | A1 | 7/2014 |
| WO | 2015/095332 | A1 | 6/2015 |
| WO | 2015/108541 | A1 | 7/2015 |

OTHER PUBLICATIONS

Office Action issued in Chinese Patent Application No. 201880062037.3 dated May 28, 2021.
International Search Report, dated Sep. 18, 2018, from corresponding PCT application No. PCT/FR2018/051802.

* cited by examiner

METHOD FOR ADAPTING AN AMOUNT OF REDUCTANT FOR CONTROLLING THE NITROGEN OXIDE POLLUTION OF GASES IN A MOTOR EXHAUST LINE

BACKGROUND OF THE INVENTION

Field of the Invention

The present invention relates to a process for adapting an amount of reducing agent for a removal of nitrogen oxides from the gases in a heat engine exhaust line of a motor vehicle, the removal of nitrogen oxides being carried out according to a selective catalytic reduction by injection of the amount of reducing agent into the line.

Description of the Related Art

More than 95% of diesel engines will be equipped with a device for treating nitrogen oxides in the exhaust line. This could apply in the very near future to gasoline fuel engines.

In order to do this, in motor vehicles, in particular with a diesel engine, it is known to equip a heat engine exhaust line with a selective catalytic reduction system having injection of reducing agent into the line, a monitoring-control unit receiving the estimates or measurements of amounts of nitrogen oxides exiting through the exhaust line at least downstream of the selective catalytic reduction system.

For the removal of nitrogen oxides or NOx, a selective catalytic reduction (SCR) system is therefore frequently used. Hereinafter in the present application, the selective catalytic reduction system could also be referred to by its abbreviation SCR, likewise the nitrogen oxides could be referred to under their abbreviation NOx and ammonia under its chemical formula NH3.

In an SCR system, use is made of a liquid reducing agent intended to be introduced in predefined amounts and by consecutive injections into an exhaust line of a motor vehicle. The addition of this pollutant-removing reducing agent treats the NOx present in the exhaust line of the heat engine of the motor vehicle. This SCR reducing agent is frequently ammonia or an ammonia precursor, for example urea or a urea derivative, in particular a mixture known under the brand Adblue®.

An SCR system typically has a tank containing an amount of liquid reducing agent, a pump for supplying liquid reducing agent to an exhaust line of a motor vehicle using an injector that opens into the exhaust line. The liquid reducing agent decomposes to give gaseous ammonia, of chemical formula NH3. The NH3 is stored in an SCR catalyst in order to reduce the NOx that are in the gases discharged by the exhaust line. This applies both for diesel vehicles and for gasoline vehicles.

Such an SCR system may be doubled or combined with one or more active or passive NOx traps. Typically, such traps store the NOx at colder exhaust temperatures. For the active systems, the NOx are reduced, during a purging operation, under conditions of richness and heat in the presence of hydrocarbons in the exhaust. For higher temperatures, a continuous injection of fuel into the exhaust line at high frequency and under high pressure has proved more efficient than the typical alternating storage and purging operations.

An SCR system, more particularly when the reducing agent is a urea derivative such as AdBlue®, is effective between medium and high temperatures and may convert the NOx continuously. An optimized control is also required for increasing the NOx treatment efficiency and optimizing the consumptions of fuel and of reducing agent, given that these parameters are all dependent, nonlinearly, on the conditions prevailing in the exhaust and during the catalysis.

The control of an SCR system may be divided into two parts: a nominal control and an adaptive control. The nominal control sets the amount of reducing agent to be injected which is calibrated as a function of the SCR system and of the test vehicle used during the development. The adaptive control sets a multiplying correction factor for the amount of reducing agent to be injected based for the vehicle on which the SCR system is actually associated, in order to adapt the system in series with deviations and dispersions that may originate from the reducing agent injector, from the NOx sensors, from the quality of reducing agent, from the metering system, from the catalysis temperature or from the exhaust flow rate, etc.

It should also be taken into account that the system may have an influence on the reduction process by giving rise to more emissions of NOx or of NH3, the NH3 corresponding to the reducing agent converted but not used for the catalysis at the outlet of the exhaust line. Generally, the adaptive control uses an NH3 sensor and/or NOx sensor or works with an estimate at the outlet of an SCR-impregnated particulate filter or of an SCR catalyst, this without taking into account the case where an auxiliary SCR system is present or if there is present a catalyst for oxidation of the excess NH3 not used for the monitoring of the catalysis at the end of the exhaust line in order to avoid releasing NH3 into the environment outside of the motor vehicle.

A control of an SCR system according to the prior art enables an adaptation of a predetermined NOx treatment efficiency according to a volume ratio or a weight concentration or a level of NOx in the exhaust line, for example a mass flow rate in grams/second.

Frequently, a nitrogen oxides sensor or NOx sensor has a dual sensitivity to nitrogen oxides and to NH3. This may be the case for a NOx sensor positioned downstream of the SCR system. It is then not possible to know directly whether it is nitrogen oxides that are detected, in which case the pollutant removal is deficient and the amount of reducing agent to be injected must be increased or whether it is NH3 that is detected, in which case the amount of reducing agent is too great and an excess of unused and unstored NH3 forms, which should lead to a control for reducing the amount of reducing agent to be injected.

Likening a detection of an excess of NH3 to a presence of nitrogen oxides in the exhaust line downstream of the SCR system leads to increasing the amount of reducing agent injected and therefore in creating even more escape of NH3. This phenomenon is known under the name system runaway.

Moreover, although the adaptive control of the prior art is supposed to take into account the dispersions of sensors, in certain scenarios, this adaptive control cannot give satisfaction. Thus, the adaptive control does not operate in the case of negative dispersion of the downstream NOx sensor. Such a negative dispersion will result in a reduction in the amount injected and reduce the actual efficiency of the NOx-removing treatment.

Generally, an adaptive control is skewed in the case of negative or positive dispersions between the two upstream and downstream NOx sensors. The measured efficiency does not take into account the dispersion, which is problematic since in most cases, the amount injected is based on the data from the upstream sensor, therefore this will result either in an escape of NH3 or in an escape of actual NOx.

The problem underlying the present invention is that of devising an adaptive correction for a selective catalytic reduction system which takes into account dispersions of the various elements that come into play during the injection of reducing agent into a motor vehicle exhaust line and in particular the upstream and downstream sensors of the system and also possible dispersions of the elements of the system.

SUMMARY OF THE INVENTION

For this purpose, the present invention relates to a process for adapting an amount of reducing agent for a removal of nitrogen oxides from the gases in an exhaust line of a heat engine of a motor vehicle, the removal of nitrogen oxides being carried out by a system according to a selective catalytic reduction by injection of the amount of reducing agent into the line, the amount of reducing agent to be injected being predetermined by a nominal control preestablished on characteristics of the system and motorization of the motor vehicle by establishing a control model that estimates an efficiency of conversion of the nitrogen oxides by the system, this nominal control being corrected while the vehicle is operating by an adaptive control that takes into account an amount of nitrogen oxides measured before and after the system by upstream and downstream nitrogen oxide sensors respectively, the adaptive correction being carried out when the amount of nitrogen oxides downstream of the system is outside of a predetermined correction range, characterized in that:

- a first alignment of the amounts of nitrogen oxides measured by the upstream and downstream nitrogen oxide sensors toward the largest amount of nitrogen oxides measured by one of the sensors with a readjusted calibration of the other sensor that has measured the lowest amount of nitrogen oxides as a function of this larger amount is carried out, this first alignment of the sensors taking place when no injection of reducing agent into the exhaust line is effective and with a catalyst of the system emptied of a store of ammonia within it,
- next, a second alignment of the reduction of the nitrogen oxides estimated by the control model with the reduction of the nitrogen oxides measured by the upstream and downstream sensors by way of a difference between amounts of nitrogen oxides upstream and downstream during a substoichiometric injection of reducing agent without creation of a store of ammonia within the catalyst of the system, this second alignment taking place via a first correction of the amount of reducing agent injected,
- after and with these first and second alignments carried out, a third alignment of an efficiency of retaining nitrogen oxides measured by the control model with an efficiency of retaining nitrogen oxides estimated by the sensors is carried out, this third alignment taking place via a second correction of the amount of reducing agent injected as an adaptive correction.

The technical effect is that of correcting all the possible dispersions in the measurements of the upstream and downstream NOx sensors and the elements of the SCR system such as the injector, for example the reducing agent metering system or the quality of reducing agent, and also of taking into account the aging of the SCR catalyst. The first measurement makes it possible to recalibrate the NOx sensors with the sensor measuring the largest amount of nitrogen oxides. The fact that this alignment with this sensor takes place without any injection of reducing agent into the exhaust line and with a catalyst of the system emptied of a store of ammonia within it means that there is no reduction of NOx in the exhaust line and that therefore the measurements of the upstream and downstream NOx sensors should be exactly the same.

The second measurement makes it possible to take into consideration the dispersions being created in the SCR system but also compensates for a first alignment of the sensors that is not carried out with the nominal values of the sensors, the nominal values being the values determined during the development of the vehicle. After correction of the dispersion of the NOx sensors, the reduction of the NOx estimated by the control model is realigned with the reduction of the NOx measured by the thus realigned upstream and downstream sensors. This is done by injecting less reducing agent than estimated in order not to have formation of a store of ammonia within the catalyst.

Finally, the efficiency of retaining nitrogen oxides estimated by the control model is corrected by a third measurement taking into account the efficiency of retaining nitrogen oxides measured by the sensors with their dispersions taken into account. It is all of these measurements that make it possible to make a successful adaptation for all of the dispersions, in particular those of the upstream NOx sensor, of the NOx sensor downstream of the injection of reducing agent, of the metering system or of the quality of reducing agent and of the aging of the SCR catalyst, etc.

After alignment of the sensors with the sensor measuring the largest amounts of NOx, the sensors are used to carry out the correction of the dispersions of the system. It should be taken into consideration that the first alignment of the amounts of nitrogen oxides measured by the upstream and downstream nitrogen oxide sensors is carried out toward the largest amount of nitrogen oxides measured by one of the sensors and is not a correction for returning to the nominal. For example, in the case of two NOx sensors dispersed at 0.9 and 0.9, or 0.9 and 0.8, a correction is not carried out at 1 and 1 of the sensors but at 0.9 and 0.9 of the sensors, i.e. an alignment with the sensor that has measured the largest amount of nitrogen oxides and not a correction to the nominal.

After this, the second alignment will carry out a correction of the amount with 1, 1 even if there are no other dispersions in the system: it may thus compensate for the first alignment with a value other than a nominal value. Ultimately, the set of the two alignments gives a good adaptation.

After application of the first and second alignments, the risks of runaway of the process according to the present invention by corrections in the opposite direction to what should be done, for example by addition of reducing agent when the actual situation is excess of NH3 or vice versa are minimized. The second correction during the third alignment is reduced and may even be annulled by the use of the first and second alignments.

Advantageously, the nominal control is corrected by the adaptive correction according to a correction factor imposed on the amount of reducing agent predetermined by the nominal correction. It was known to correct the predetermined amount of reducing agent with the nominal correction via a correction factor according to the prior art but this correction factor did not take into account dispersions, on the one hand, specific to the upstream and downstream NOx sensors and, on the other hand, specific to the SCR reduction system.

Advantageously, the correction factor of the amount of reducing agent predetermined by the nominal correction is a multiplying factor.

Advantageously, the correction range is determined so that the nominal control carries out only a downward correction of the amount of reducing agent injected into the line from a point of the correction range corresponding to an amount of reducing agent injected that results in a maximum amount of ammonia allowable as escape via the exhaust line.

In this embodiment, the development of the SCR system is made with a system with a maximum escape of NH3. Thus, all the deviations and dispersions will be in the direction of the escape of NOx and not of the escape of NH3, which would cause worries for the efficiency controller, given that an escape of NH3 may be confused by the dual-sensitivity downstream sensor with an escape of NOx. The adaptive correction and the efficiency controller will then correct as an excess of untreated NOx and will increase the amount of reducing agent injected.

Advantageously, for the alignment of the amounts of nitrogen oxides measured by the upstream and downstream nitrogen oxides sensors and the readjusted calibration of the sensor that has measured the lowest amount of nitrogen oxides, an integration of the amounts of nitrogen oxides during a distance travelled is carried out for each of the two sensors and, if a difference exists between the integrations of the two sensors, a weighting factor that is a function of this difference is determined for readjusting the calibration of the sensor that has measured the lowest amount of nitrogen oxides.

The invention also relates to an assembly of a selective catalytic reduction system and of an exhaust line of gases resulting from a combustion in a vehicle heat engine, the line housing within it a catalyst of the selective catalytic reduction system and being passed through by an injector of reducing agent upstream of the catalyst, the line integrating a nitrogen oxides sensor upstream of the catalyst and a nitrogen oxides sensor downstream of the catalyst, the selective catalytic reduction system comprising a monitoring-control unit that has means for determining a nominal amount of reducing agent to be injected into the line and means for correction of the nominal amount according to the measurements of the sensors received by receiving means of the monitoring-control unit, characterized in that the assembly uses such a process. Advantageously, the downstream sensor is a non-selective sensor of nitrogen oxides and also measures an amount of ammonia not used or not stored in the catalyst and being released into the exhaust line.

As the present invention renders superfluous the use, as downstream nitrogen oxides sensor, of a sensor that differentiates between an amount of nitrogen oxides and an amount of escape of ammonia not used or not stored for the catalysis after degradation of the reducing agent to ammonia and discharged into the exhaust line, a saving is thus made in the pollutant-removing equipment of the exhaust line.

Advantageously, the line comprises at least one of the following elements: an ammonia slip catalyst positioned downstream of the selective catalytic reduction system, at least one passive nitrogen oxide trap or one active nitrogen oxide trap positioned upstream of the selective catalytic reduction system and/or an auxiliary catalytic reduction system optionally integrated into a particulate filter and an oxidation catalyst when the engine is a diesel engine or a three-way catalyst when the engine is a gasoline engine.

BRIEF DESCRIPTION OF THE DRAWINGS

Other features, aims and advantages of the present invention will become apparent upon reading the detailed description that will follow and upon examining the appended drawings, given by way of non-limiting examples and in which.

DESCRIPTION OF THE PREFERRED EMBODIMENTS

Figure 1:
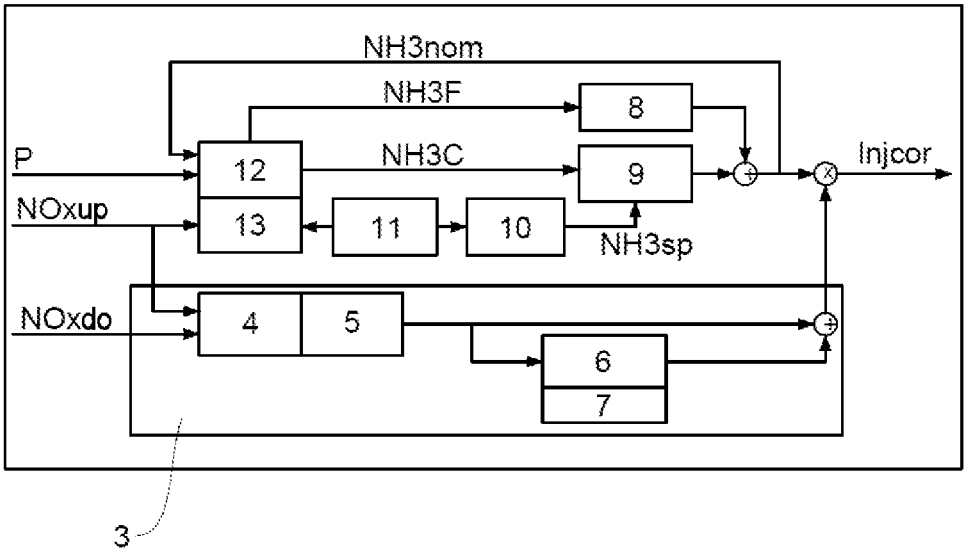
FIG. 1 is a schematic representation of a perspective view of an assembly of a nominal control module associated with an efficiency controller, the process according to the present invention being able to be used for this assembly.

FIG. 1 shows a control of an amount of reducing agent for a removal of nitrogen oxides from the gases in a heat engine exhaust line of a motor vehicle, the removal of nitrogen oxides being carried out according to a selective catalytic reduction by injection of the amount of reducing agent into the line.

The amount of reducing agent to be injected is predetermined by a nominal control NH3 nom essentially illustrated by the modules 8 to 13. This nominal control NH3 nom is preestablished on characteristics of the system and a motorization of the motor vehicle, characteristics referenced P which are stored in a storage model 12. A control model represented by the module 13 estimates an amount of nitrogen oxides converted starting from an estimated efficiency and a measured or estimated upstream amount of nitrogen oxides NOxup.

It is also possible to provide a module that stores a temperature model 11, a module of setpoint of an amount of NH3 10 referenced NH3sp, which compares it to the estimated amount of NH3 stored NH3C, resulting from the storage model 12, via a controller 9. This controller 9 may thus increase or decrease the nominal setpoint, sum of the outputs of the pre-control module 8 and of the controller 9. The parameter NH3F derived from the pre-control module 8 corresponds to the amount of NH3 used for the conversion of the NOx and increased for the losses by oxidation or escape of NH3.

The nominal control is corrected while the vehicle is operating by an adaptive control derived essentially from an efficiency controller referenced 3 in FIG. 1. This adaptive control takes into account an amount of nitrogen oxides measured upstream NOxup and downstream NOxdoi of the system by upstream and downstream nitrogen oxides sensors respectively, the adaptive correction being carried out when the amount of nitrogen oxides downstream NOxdo of the system is outside of a predetermined correction range.

The efficiency controller 3 comprises a module for calculating the efficiency of the NOx reduction 4 and a module for controlling the efficiency of the NOx reduction 5 as a function of the data from the module for calculating the efficiency of the NOx reduction 4 which are transmitted thereto. The module for controlling the efficiency of the NOx reduction 5 sends an adaptive correction, if need be, modified by addition of a correction derived from an adaptation monitor 7 and an adapter of injection over the long term 6 as a function of the data which are transmitted thereto by the module for controlling the efficiency of the NOx reduction 5. The adaptive correction, if need be modified, is sent at the end of nominal control in order to correct the amount of reducing agent injected Injcor. It is advantageously used as a multiplying correction factor for correcting the amount of reducing agent injected Injcor.

The essential characteristics of the present invention will now be described with regard to FIG. 2.

In the process for adapting an amount of reducing agent for a removal of nitrogen oxides from the gases in a heat engine exhaust line of a motor vehicle, a first alignment of the amounts of nitrogen oxides measured MCupSD, MCdoSD by the upstream and downstream nitrogen oxides sensors is carried out. This is illustrated by module 1 of FIG. 2.

This first alignment is carried out toward the largest amount of nitrogen oxides measured by one of the sensors with a readjusted calibration of the other sensor that has measured the lowest amount of nitrogen oxides as a function of this larger amount. The result of this alignment is referenced ALSen in this FIG. 2 for alignment of the sensors.

The alignment of the sensors takes place when no injection of reducing agent into the exhaust line is effective and with a catalyst of the SCR system emptied of a store of ammonia within it, giving respectively a measurement of the upstream sensor without injection or pollutant removal MCupSD and a measurement of the downstream sensor without injection or pollutant removal MCdoSD. Under these conditions, no pollutant removal is carried out owing to the absence of reducing agent in the line and the measurements of the two sensors MCupSD and MCdoSD should be the same.

If this is not the case, the alignment of the upstream or downstream sensor that has detected the lowest amount of NOx in the line with the downstream or upstream sensor that has detected the highest amount of NOx in the line is carried out for the alignment of the two sensors.

Next, a second alignment of the reduction of the nitrogen oxides estimated by the control model with the reduction of the nitrogen oxides measured by the upstream and downstream sensors is carried out. This is referenced by the module 2 and is carried out by way of a difference between measurements of amounts of nitrogen oxides upstream and downstream noted MCupSS and MCdoSS respectively by the previously realigned sensors.

This difference between the amounts of nitrogen oxides upstream and downstream noted MCupSS and MCdoSS is carried out during a substoichiometric injection of reducing agent without creation of a store of ammonia within the catalyst of the system. This means that, since the injection is substoichiometric, the entire amount of reducing agent is used for and is consumed for a removal of nitrogen oxides and may even be insufficient for satisfactorily reducing all the NOx, the latter objective not being the desired objective for this second alignment 2, this second alignment 2 being used only for reducing the dispersions in the SCR system and also for correcting the values of the sensors when these have not been aligned with a nominal value.

Such a second alignment makes it possible to reduce the existing dispersions in the reduction system, for example in particular the dispersions of the injector, of the amount of reducing agent injected, of the aging of the SCR catalyst, which is not limiting. Such a reduction of the dispersions of the system is referenced ALSys for alignment of the system. The second alignment is carried out by a first correction of the amount of reducing agent injected then taking into account the dispersions in the SCR system.

Figure 2:
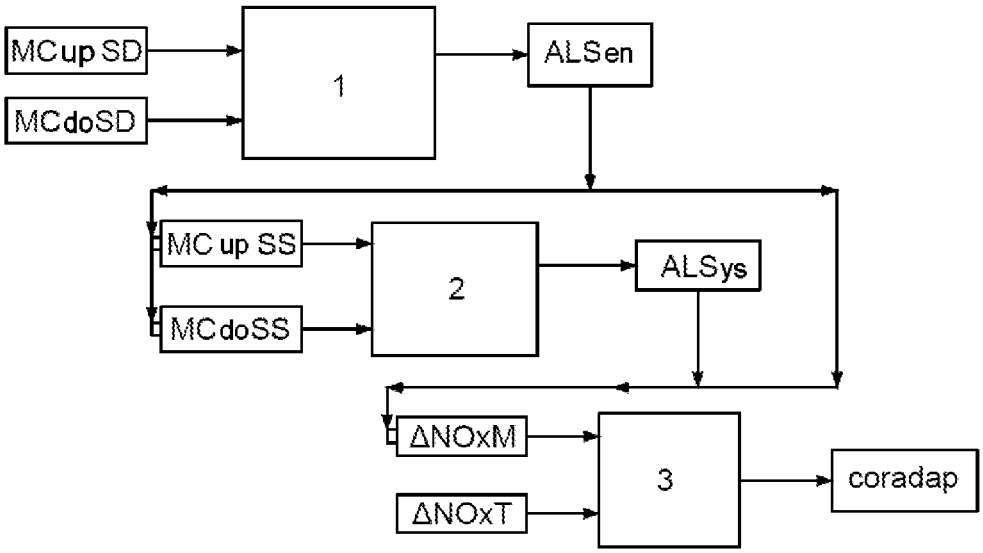
FIG. 2 is a schematic representation of a logic diagram of the process according to the present invention, with three types of alignment taking into account the dispersions of the sensors and of the selective catalytic reduction system.

After and with these first and second alignments 1, 2 carried out which have corrected, on the one hand, the dispersions between upstream and downstream NOx sensors and, on other hand, the dispersions in the SCR system while having, if need be, taken into account an alignment of the sensors with a non-nominal value, a third alignment 3 of an efficiency of retaining nitrogen oxides measured by the control model with an efficiency of retaining nitrogen oxides estimated by the sensors is carried out, the control model being part of the efficiency controller referenced 3 in FIGS. 1 and 2.

This third alignment 3, similar to what an efficiency controller carries out apart from the difference that it works on parameters with corrected dispersions, is carried out by a second correction of the amount of reducing agent injected as adaptive correction referenced Coradap. The difference in measured efficiency ΔNOxM and in desired efficiency ΔNOxT resulting from the efficiency model 13 and from the module for calculating the efficiency 4 referenced in FIG. 1 are then compared and an adaptive correction Coradap is carried out when these two differences ΔNOxM and ΔNOxT are not similar.

This is carried out with aligned sensors ALSen and an aligned SCR system ALSys, i.e. a system in which the main dispersions have been taken into account and under pollutant-removing conditions preestablished by the nominal control.

Thus, for devising the adaptive correction Coradap emitted by the adaptive control for correcting the nominal control, it is possible to take into account and to correct all the possible dispersions in the measurements of the upstream and downstream NOx sensors and the elements of the SCR system such as the injector, the reducing agent metering system or the quality of reducing agent, and also to take into account the aging of the SCR catalyst.

The nominal control may be corrected by the adaptive correction Coradap according to a correction factor imposed on the amount of reducing agent predetermined by the nominal correction. The correction factor of the amount of reducing agent predetermined by the nominal correction may be a multiplying factor.

The correction range of the nominal control may be determined so that the nominal control carries out only a downward correction of the amount of reducing agent injected into the line from a point of the correction range corresponding to an amount of reducing agent injected that results in a maximum amount of ammonia allowable as escape via the exhaust line.

Specifically, it is common for the downstream NOx sensor to have a mixed sensitivity to NH3 and to NOx, in which case it is impossible for the control to know if there is actually an escape of NH3 or if the removal of the NOx is deficient. However, this represents contradictory diagnoses and solutions to be implemented that are completely opposite, an escape of NH3 requiring a reduction in the amount of reducing agent to be injected whereas an unsatisfactory removal of NOx requires an increase in the amount of reducing agent to be injected. This could lead to a runaway of the system, the control injecting more and more reducing agent in order to reduce a supposed unreduced amount of NOx which does not actually exist whereas the control should treat an unacknowledged escape of NH3.

Thus, the present invention may make it possible to not use a downstream nitrogen oxides sensor that differentiates between an amount of nitrogen oxides and an amount of escape of ammonia not used or not stored for the catalysis after degradation of the reducing agent to ammonia and discharged into the exhaust line.

Figure 3:
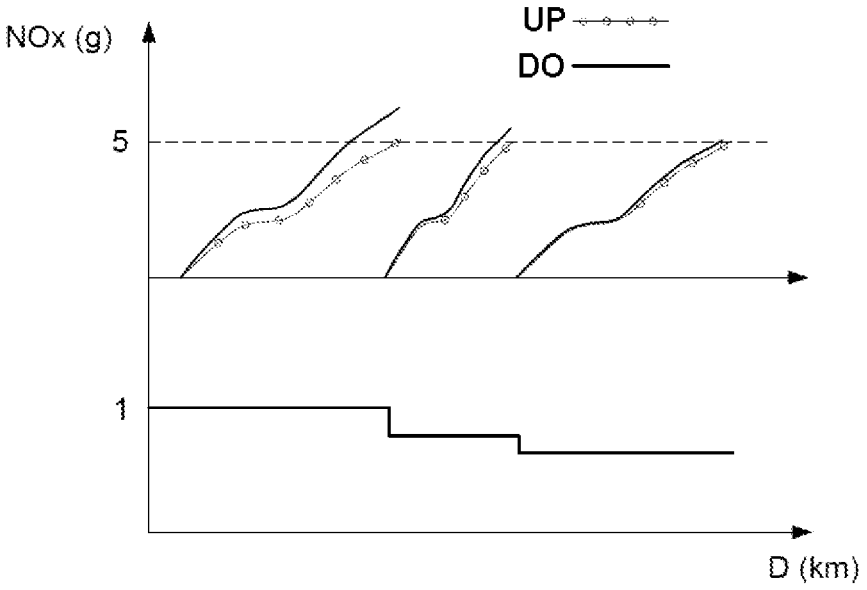
FIG. 3 shows a process of the first alignment of the upstream and downstream sensors with the sensor measuring the largest amount of nitrogen oxides as a function of the distance travelled, this first alignment being carried out according to a preferential embodiment in accordance with the present invention.

FIG. 3 shows a process of aligning the upstream and downstream NOx sensors relative to one another over a distance D in kilometres km with, on the y-axis, an amount in grams g of NOx in the line. For the first alignment, which is that of the NOx sensors, this first alignment is carried out without implementation of a removal of NOx in the exhaust line, i.e. without injection of reducing agent into the line nor prior retention of reducing agent in the catalyst: the values of the amount of NOx detected by the upstream and downstream sensors should therefore be the same in this scenario.

In FIG. 3, it is the upstream sensor, the measurements of which are represented by the UP curves with dots, which detect lower values of amounts of NOx than those detected by the downstream sensor, the measurements of which are represented by the solid-line DO curves. This is not limiting and the contrary may also be possible.

For the alignment of the amounts of nitrogen oxides respectively measured by the upstream and downstream nitrogen oxide sensors and the readjusted calibration of the sensor that has measured the lowest amount of nitrogen oxides, in FIG. 3 the upstream NOx sensor, an integration of the amounts of nitrogen oxides is carried out over a distance travelled D for each of the two sensors.

If a difference exists between the integrations of the two sensors, which is the case in FIG. 3, a weighting factor that is a function of this difference is determined for readjusting the calibration of the sensor that has measured the lowest amount of nitrogen oxides. This weighting factor may be a dividing weighting factor.

This calibration is carried out gradually and in a convergent manner as shown by the three pairs of curves corresponding to the upstream and downstream sensors which gradually move closer to one another in FIG. 3.

By analogy with what was shown for the alignment of the two NOx sensors, a similar process may be carried out for the first correction of the amount of reducing agent injected, the first correction taking place under substoichiometric conditions, i.e. under conditions of a deficit of reducing agent in the line and the second correction under conditions set by the nominal control, therefore in theory under optimal operating conditions for the removal of NOx from the exhaust line.

Figure 4:
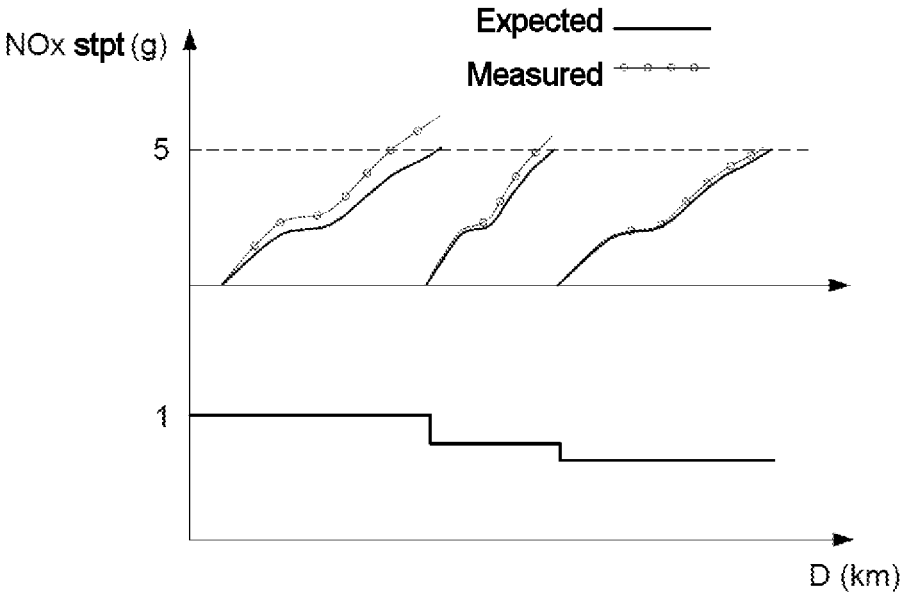
FIG. 4 shows a process of the third alignment of the amounts of nitrogen measured and expected as a function of the distance travelled, this third alignment being carried out according to a preferential embodiment in accordance with the present invention.

This is shown in FIG. 4 and is substantially similar to what was shown in FIG. 3. Shown in FIG. 4 are three convergent pairs of amounts of NOx that are measured, illustrated by dotted curves, and that are expected, by the nominative control for the second correction, being illustrated by solid-line curves. The x-axis is a distance D in kilometers km and the y-axis is a setpoint of nitrogen oxides NOx stpt in grams g.

Thus, for the first correction of the amount of reducing agent injected during the second alignment, respective integrations of the estimated or expected amounts of nitrogen oxides reduced and of the measured amounts of nitrogen oxides reduced may be carried out over a distance travelled.

If a respective difference exists between integrations of the two expected and measured amounts of nitrogen oxides, which is the case in FIG. 4, the measured amount being greater than the amount expected by the nominal control, a weighting factor that is a function of this difference may be determined for correcting the reduction of the nitrogen oxides estimated by the control module. This weighting factor may be a multiplying weighting factor.

The correction of the measured and expected amounts toward a coming together of these two amounts may take place gradually and in a convergent manner as shown by the three pairs of curves corresponding to the upstream and downstream sensors which gradually move closer to one another in FIG. 4.

Figure 5:
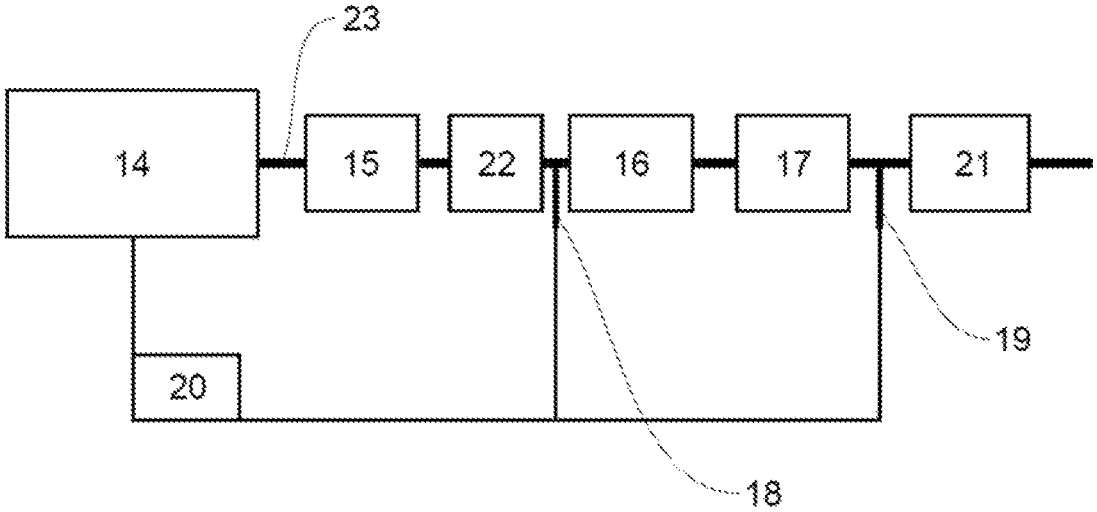
FIG. 5 shows an example of assembly of a selective catalytic reduction system and of an exhaust line of gases resulting from a combustion in a vehicle heat engine for the implementation of the process according to the present invention.

As shown in FIG. 5, the invention also relates to an assembly of a selective catalytic reduction system 17 and of an exhaust line 23 of gases resulting from a combustion in a vehicle heat engine 14. The line 23 houses within it a catalyst of the selective catalytic reduction system 17 and is passed through by an injector of reducing agent upstream of the catalyst, not represented in FIG. 5. Line 23 integrates a nitrogen oxides sensor upstream 18 of the catalyst and a nitrogen oxides sensor downstream 19 of the catalyst.

The selective catalytic reduction system 17 comprises a monitoring-control unit 20 that has means for determining a nominal amount of reducing agent to be injected into the line 23 and means for correction of the nominal amount according to the measurements of the sensors 18, 19 received by receiving means of the monitoring-control unit 20. The assembly uses a process as described above.

The downstream sensor 19 may be a non-selective sensor of nitrogen oxides and may also measure an amount of ammonia not used or not stored in the catalyst and being released into the exhaust line 23.

The exhaust line 23 may comprise at least one of the following elements: an ammonia slip catalyst 21 positioned downstream of the selective catalytic reduction system 17, at least one passive nitrogen oxide trap or one active nitrogen oxide trap 22 positioned upstream of the selective catalytic reduction system 17 and/or an auxiliary catalytic reduction system optionally integrated into a particulate filter 16 and an oxidation catalyst 15 when the engine 14 is a diesel engine or a three-way catalyst when the engine 14 is a gasoline engine.

There may for example be two consecutive SCR catalysts in the exhaust line 23 with an exhaust coupling connecting the two SCR catalysts. There may also be a nitrogen oxide trap associated with an SCR catalyst or an SCR catalyst associated with a particulate filter 16 as first and second pollutant-removing elements.

The catalyst for destroying releases of ammonia of chemical formula NH3, also referred to as "Clean Up Catalyst" or "Ammonia Slip Catalyst" removes the excess NH3 not used for the selective catalytic reduction in at least one SCR catalyst present in the exhaust line 23. In this case, the ammonia slip catalyst is positioned further downstream in the exhaust line 23 than the other pollutant-removing elements, this being taken along a path of the exhaust gases in the assembly.

It is also possible to use an active nitrogen oxide trap 15 without additive of the LNT or "Lean NOx Trap" type. Such a trap 15 eliminates the $NO_x$ via a brief passage into richness of one or more in the gases output from the engine 14. The surplus hydrocarbons react with the stored $NO_x$ and neutralize them by converting them into nitrogen gas.

Another system in the form of a PNA (Passive $NO_x$ Adsorber) trap may also be used. This trap is said to be passive because there is no passage into richness of one or more for $NO_x$ purification.

Such passive or active $NO_x$ traps may be used in combination with the selective catalytic reduction system 17 already present on the line 23. This makes it possible to increase the effectiveness of elimination of nitrogen oxides by adsorption of the nitrogen oxides at low temperature and desorption of the oxides once the catalyst of the reduction system 17 is active. The catalyst of the SCR system 17 is frequently placed downstream of the $NO_x$ trap 15, whether this is active or passive.

Other sensors such as a pressure sensor at the ends of the particulate filter 16, an oxygen probe or a soot sensor and a reducing agent mixer in the line 23 may also be present.

The invention claimed is:

1. A process for adapting an amount of reducing agent for a removal of nitrogen oxides from gases in an exhaust line of a heat engine of a motor vehicle, the removal of nitrogen oxides being carried out by a system according to a selective catalytic reduction by injection of the amount of reducing agent into the exhaust line, the amount of reducing agent injected being predetermined by a nominal control pre-established on characteristics of the system and motorization of the motor vehicle by establishing a control model that estimates an efficiency of conversion of the nitrogen oxides by the system, the nominal control being corrected while the motor vehicle is operating by an adaptive control that takes into account an amount of nitrogen oxides measured before and after the system by upstream and downstream nitrogen oxide sensors respectively, the adaptive control including an adaptive correction which is carried out when the amount of nitrogen oxides downstream of the system is outside of a predetermined correction range, the process comprising:

aligning the amounts of nitrogen oxides measured by the upstream and downstream nitrogen oxide sensors toward a largest amount of nitrogen oxides measured by one of the upstream and downstream nitrogen oxide sensors with a readjusted calibration of the other sensor of the upstream and downstream nitrogen oxide sensors that has measured a lowest amount of nitrogen oxides as a function of the largest amount, the aligning of the nitrogen oxides measured by the upstream and downstream nitrogen oxide sensors taking place when no injection of reducing agent into the exhaust line is effective and with a catalyst of the system emptied of a store of ammonia within the system;

aligning the reduction of the nitrogen oxides estimated by the control model with the reduction of the nitrogen oxides measured by the upstream and downstream sensors by a difference between amounts of nitrogen oxides upstream and downstream during a substoichiometric injection of reducing agent without creation of the store of ammonia within the catalyst of the system, the aligning the reduction of the nitrogen oxides taking place via a first correction of the amount of reducing agent injected, after the aligning of the nitrogen oxides measured by the upstream and downstream nitrogen oxide sensors; and aligning an efficiency of retaining nitrogen oxides measured by the control model with an efficiency of retaining nitrogen oxides estimated by the sensors after the aligning of the nitrogen oxides measured by the upstream and downstream nitrogen oxide sensors and after the aligning the reduction of the nitrogen oxides, the aligning the efficiency of the retaining nitrogen oxides taking place via a second correction of the amount of reducing agent injected as the adaptive correction.

2. The process as claimed in claim 1, wherein the nominal control is corrected by the adaptive correction according to a correction factor imposed on the amount of reducing agent predetermined by a nominal correction.

3. The process as claimed in claim 2, wherein the correction factor of the amount of reducing agent predetermined by the nominal correction is a multiplying factor.

4. The process as claimed in claim 3, wherein the predetermined correction range is determined so that the nominal control carries out only a downward correction of the amount of reducing agent injected into the exhaust line from a point of the predetermined correction range corresponding to the amount of reducing agent injected that results in a maximum amount of ammonia allowable as an escape amount via the exhaust line.

5. The process as claimed in claim 3, wherein the downstream nitrogen oxides sensor does not differentiate between an amount of nitrogen oxides and an amount of escape of ammonia not used or not stored for catalysis after degradation of the reducing agent to ammonia and discharged into the exhaust line.

6. The process as claimed in claim 3, wherein, for the first correction of the amount of reducing agent injected, respective integrations of the estimated amounts of nitrogen oxides are reduced and the measured amounts of nitrogen oxides are reduced during a distance travelled, and, when a respective difference exists between the integrations of the estimated and measured amounts of nitrogen oxides, a weighting factor that is a function of the respective difference is determined to correct the reduction of the nitrogen oxides estimated by the control model.

7. The process as claimed in claim 2, wherein the predetermined correction range is determined so that the nominal control carries out only a downward correction of the amount of reducing agent injected into the exhaust line from a point of the predetermined correction range corresponding to the amount of reducing agent injected that results in a maximum amount of ammonia allowable as an escape amount via the exhaust line.

8. The process as claimed in claim 2, wherein the downstream nitrogen oxides sensor does not differentiate between an amount of nitrogen oxides and an amount of escape of ammonia not used or not stored for catalysis after degradation of the reducing agent to ammonia and discharged into the exhaust line.

9. The process as claimed in claim 2, wherein, for the first correction of the amount of reducing agent injected, respective integrations of the estimated amounts of nitrogen oxides are reduced and the measured amounts of nitrogen oxides are reduced during a distance travelled, and, when a respective difference exists between the integrations of the estimated and measured amounts of nitrogen oxides, a weighting factor that is a function of the respective difference is determined to correct the reduction of the nitrogen oxides estimated by the control model.

10. The process as claimed in claim 1, wherein the predetermined correction range is determined so that the nominal control carries out only a downward correction of the amount of reducing agent injected into the exhaust line from a point of the predetermined correction range corresponding to the amount of reducing agent injected that results in a maximum amount of ammonia allowable as an escape amount via the exhaust line.

11. The process as claimed in claim 10, wherein the downstream nitrogen oxides sensor does not differentiate between an amount of nitrogen oxides and an amount of escape of ammonia not used or not stored for catalysis after degradation of the reducing agent to ammonia and discharged into the exhaust line.

12. The process as claimed in claim 10, wherein, for the first correction of the amount of reducing agent injected, respective integrations of the estimated amounts of nitrogen oxides are reduced and the measured amounts of nitrogen oxides are reduced during a distance travelled, and, when a respective difference exists between the integrations of the estimated and measured amounts of nitrogen oxides, a weighting factor that is a function of the respective difference is determined to correct the reduction of the nitrogen oxides estimated by the control model.

13. The process as claimed in claim 1, wherein the downstream nitrogen oxides sensor does not differentiate between an amount of nitrogen oxides and an amount of escape of ammonia not used or not stored for catalysis after degradation of the reducing agent to ammonia and discharged into the exhaust line.

14. The process as claimed in claim 13, wherein, for the first correction of the amount of reducing agent injected, respective integrations of the estimated amounts of nitrogen oxides are reduced and the measured amounts of nitrogen oxides are reduced during a distance travelled, and, when a respective difference exists between the integrations of the estimated and measured amounts of nitrogen oxides, a weighting factor that is a function of the respective difference is determined to correct the reduction of the nitrogen oxides estimated by the control model.

15. The process as claimed in claim 1, wherein, for the first correction of the amount of reducing agent injected, respective integrations of the estimated amounts of nitrogen oxides are reduced and the measured amounts of nitrogen oxides are reduced during a distance travelled, and, when a respective difference exists between the integrations of the estimated and measured amounts of nitrogen oxides, a weighting factor that is a function of the respective difference is determined to correct the reduction of the nitrogen oxides estimated by the control model.

16. An assembly, the assembly comprising:

a selective catalytic reduction system; and an exhaust line of gases resulting from a combustion in a vehicle heat engine, the exhaust line housing a catalyst of the selective catalytic reduction system and being passed through by an injector of reducing agent upstream of the catalyst, the exhaust line integrating a nitrogen oxides sensor upstream of the catalyst and a nitrogen oxides sensor downstream of the catalyst, wherein the selective catalytic reduction system comprises a monitoring-controller configured to determine a nominal amount of reducing agent to be injected into the exhaust line and configured to execute the process of claim 1 to adaptively correct the nominal amount according to the measurements of the upstream and downstream nitrogen oxide sensors received by the monitoring-controller while the selective catalytic reduction system is operating.

17. The assembly as claimed in claim 16, wherein the downstream sensor is a non-selective sensor of nitrogen oxides and measures an amount of ammonia not used or not stored in the catalyst and discharged into the exhaust line.

18. The assembly as claimed in claim 17, wherein the exhaust line comprises one or more of:

an ammonia slip catalyst positioned downstream of the selective catalytic reduction system, at least one passive nitrogen oxide trap or one active nitrogen oxide trap positioned upstream of the selective catalytic reduction system, and an auxiliary catalytic reduction system and an oxidation catalyst when the vehicle heat engine is a diesel engine or a three-way catalyst when the vehicle heat engine is a gasoline engine.

19. The assembly as claimed in claim 16, wherein the exhaust line comprises at least one or more of:

an ammonia slip catalyst positioned downstream of the selective catalytic reduction system, at least one passive nitrogen oxide trap or one active nitrogen oxide trap positioned upstream of the selective catalytic reduction system, and an auxiliary catalytic reduction system and an oxidation catalyst when the vehicle heat engine is a diesel engine or a three-way catalyst when the vehicle heat engine is a gasoline engine.

* * * * *